United States Patent [19]

Harada et al.

[11] Patent Number: 5,015,107

[45] Date of Patent: May 14, 1991

[54] TYPE-WHEEL CASSETTE POSITIONER FOR PRINTER

[75] Inventors: Yuichi Harada, Sakurahon; Masaya Funamoto, Higashi, both of Japan

[73] Assignee: Brother Kogyo Kabushiki Kaisha, Nagoya, Japan

[21] Appl. No.: 318,556

[22] Filed: Mar. 3, 1989

[30] Foreign Application Priority Data

Mar. 5, 1988 [JP] Japan ..... 63-29591[U]

[51] Int. Cl.[5] ..... B41J 1/00

[52] U.S. Cl. ..... 400/144.2; 400/175; 400/248.1

[58] Field of Search ..... 400/144.2, 175, 247, 400/248, 248.1, 248.2

[56] References Cited

U.S. PATENT DOCUMENTS

| | | | |
|---|---|---|---|
| 4,124,312 | 11/1978 | Johnson | 400/144.2 |
| 4,127,335 | 11/1978 | Bogert et al. | 400/144.2 |
| 4,127,337 | 11/1978 | Bogert et al. | 400/144.2 |
| 4,209,262 | 6/1980 | Savage et al. | 400/144.2 |
| 4,245,916 | 1/1981 | Habich et al. | 400/144.2 |
| 4,291,993 | 9/1981 | Gagnebin | 400/175 |
| 4,310,255 | 1/1982 | Asano et al. | 400/171 |
| 4,370,071 | 1/1983 | Habich et al. | 400/175 |
| 4,389,129 | 6/1983 | Sugiura | 400/144.2 |
| 4,408,909 | 10/1983 | Asano et al. | 400/144.2 |
| 4,410,288 | 10/1983 | Holmes | 400/144.2 |
| 4,423,971 | 1/1984 | Hira et al. | 400/144.2 |
| 4,705,416 | 11/1987 | Asakura | 400/144.2 |
| 4,747,710 | 5/1988 | Iwata et al. | 400/175 |
| 4,820,666 | 4/1989 | Link | 400/175 |
| 4,960,337 | 10/1990 | Kazo et al. | 400/248 |

FOREIGN PATENT DOCUMENTS

| | | | |
|---|---|---|---|
| 0043214 | 1/1982 | European Pat. Off. . | |
| 2037664 | 7/1980 | United Kingdom | 400/144.2 |
| 2135246 | 7/1984 | United Kingdom | 400/144.2 |

*Primary Examiner*—Clifford D. Crowder
*Assistant Examiner*—John S. Hilten
*Attorney, Agent, or Firm*—Jones, Tullar & Cooper

[57] ABSTRACT

A type-wheel cassette accommodating a type wheel is mounted on a carriage movable along a printing line on a platen. On the carriage is mounted a holder, on which a printing hammer and a type selection mechanism are mounted. The holder has a pair of first urging pieces extending toward the type-wheel cassette. An ink ribbon guide member intervening between the type-wheel cassette and platen has a pair of second urging pieces extending toward the type-wheel cassette. The first and second urging pieces are in contact with the opposite sides of the type-wheel cassette mounted on the carriage in the neighborhood of the printing position. The second urging pieces urge the type-wheel cassette toward the first urging pieces with the elastic spring force of the ink ribbon guide member, whereby the type-wheel cassette is positioned.

5 Claims, 3 Drawing Sheets

TYPE-WHEEL CASSETTE POSITIONER FOR PRINTER

BACKGROUND OF THE INVENTION

This invention relates to a printer as a typewriter, a computer terminal, etc., which has a platen and support frame means such as a carriage movable relative to the platen in a printing direction, and in which a type-wheel cassette accommodating a type-wheel is removably mounted on the support frame means, the type-wheel in the type-wheel cassette is rotated by type selection means mounted on the support frame means, and a selected type is hammered at a printing position by a printing hammer mounted on the support frame means to effect printing, and more particularly, to a type-wheel cassette positioner for such a printer.

As a printer of this type, there is known a typewriter with a carriage movable along a printing line, the carriage being provided with a paper guide member forming a paper passage space with a platen, an ink ribbon guide member forming an ink ribbon running space with the paper guide member, a type-wheel cassette accommodating a type-wheel, type selection means disposed on the side of the type-wheel cassette opposite the platen and coupled to the type-wheel in a state penetrating the center of rotation of the type-wheel cassette for selecting a given type by rotating the type-wheel, and a printing hammer for hammering a selected type against the platen. The ink ribbon guide member is mounted on the paper guide member to define the ink ribbon running space between the two. The type-wheel in the type-wheel cassette is coupled to the selection means to determine the position of the type-wheel cassette. The size of the paper passage space is adjusted by adjusting the mounting position of the paper guide member. The size of the gap between the type-wheel and type-wheel cassette inner wall is determined as the type-wheel cassette is urged by the leaf spring toward the paper guide member from the side of the type selection means.

With this prior art printer structure, however, the position of the mounted type-wheel cassette is subject to variation due to adjustment of the mounting position of the paper guide member. Therefore, the size of the gap between the ink ribbon guide member and type-wheel, and the paper passage space are subject to variations. This means that adjustment of the individual gaps noted above to appropriate sizes in a narrow space between the printing hammer and platen requires adjustment of the individual components at the time of the mounting and assembly of these components. The adjustment, therefore, is very cumbersome and time-consuming.

SUMMARY OF THE INVENTION

This invention is intended in order to solve the problems noted above in the prior art printer, and its object is to provide a type-wheel cassette positioner for a printer, which permits easier and more accurate positioning of the type-wheel cassette between, the platen and printing hammer, and which greatly alleviates the cumbersomeness of adjustment of various components.

To attain the above object of the invention, there is provided a type-wheel cassette positioner for a printer, which comprises a platen, a type-wheel cassette rotatably accommodating a type-wheel with a plurality of types, the type-wheel cassette having a first side wall closer to the platen and a second side surface more apart from the platen than the firs side surface, type selection means for rotatably driving the type-wheel to selectively position a type on the type-wheel at a printing position facing the platen in engagement with the type-wheel, printing hammer means disposed on the side of the type-wheel cassette opposite the platen for effecting a printing operation by hammering the selected type of the type-wheel at the printing position against the platen, and support frame means for supporting the type-wheel cassette such that the type-wheel cassette can be removed from the mounting position thereof and capable of displacement relative to the platen along a printing line defined on the platen.

The type-wheel cassette positioner comprises a holder supported by the support frame means on the side of the platen opposite the type-wheel cassette for supporting the type selection means and printing hammer means, first positioning means formed integrally with the holder, extending toward the type-wheel cassette located at a mounting position on the support frame means and capable of engagement with the second side surface, an intervening member secured to the support frame means and located between the type-wheel cassette at the mounting position and the platen, and the positioning means integral with the intervening member for positioning the type-wheel cassette to a given position in engagement with the first side surface of the type-wheel cassette at the mounting position in co-operation with the first positioning means of the holder.

With the type-wheel cassette positioner according to the invention, the type-wheel cassette is positively positioned from its opposite sides by the first positioning means provided on the holder and second positioning means provided on the intervening member. In addition, since the type selection means and printing hammer means are provided on the holder, the holder can be a reference member for positioning to ensure easier and more accurate positioning of the type-wheel cassette.

In a preferred structure of the type-wheel cassette positioner according to the invention, the first and second positioning means are disposed face to face on the opposite side of the type-wheel cassette in the neighborhood of the type in the printing position. Thus, it is possible to set accurately the gaps between the type in the printing position and other components, for which utmost positional accuracy is required.

As a further preferred structure of the type-wheel cassette positioner according to the invention, the intervining member with the second positioning means is composed of a leaf spring member for biasing the type-wheel cassette toward the first positioning means via contact between the second positioning means and first side surface of the type-wheel cassette. Thus, the second side surface of the type-wheel cassette can be brought into more positive contact with the first positioning means, thus enhancing the effect of the holder as a reference member for positioning.

As a still further preferred structure of the type cassette positioner according to the invention, the first and second positioning means are formed with a press as the holder and intervening member, respectively, from plate-like materials. Thus, these positioning means can be formed easily, and further improvement of the accuracy of positioning and adjustment can be obtained.

These and other objects and advantages of the present invention will be more completely defined below with reference to the following detailed description taken in conjunction with the accompanying drawings.

DETAILED DESCRIPTION OF THE PREFERRED EMBODIMENT

Now, a typewriter having a movable carriage with support frame means will be described as a printer incorporating an embodiment of the type-wheel cassette positioner according to the invention with reference to the drawings.

Figure 1:
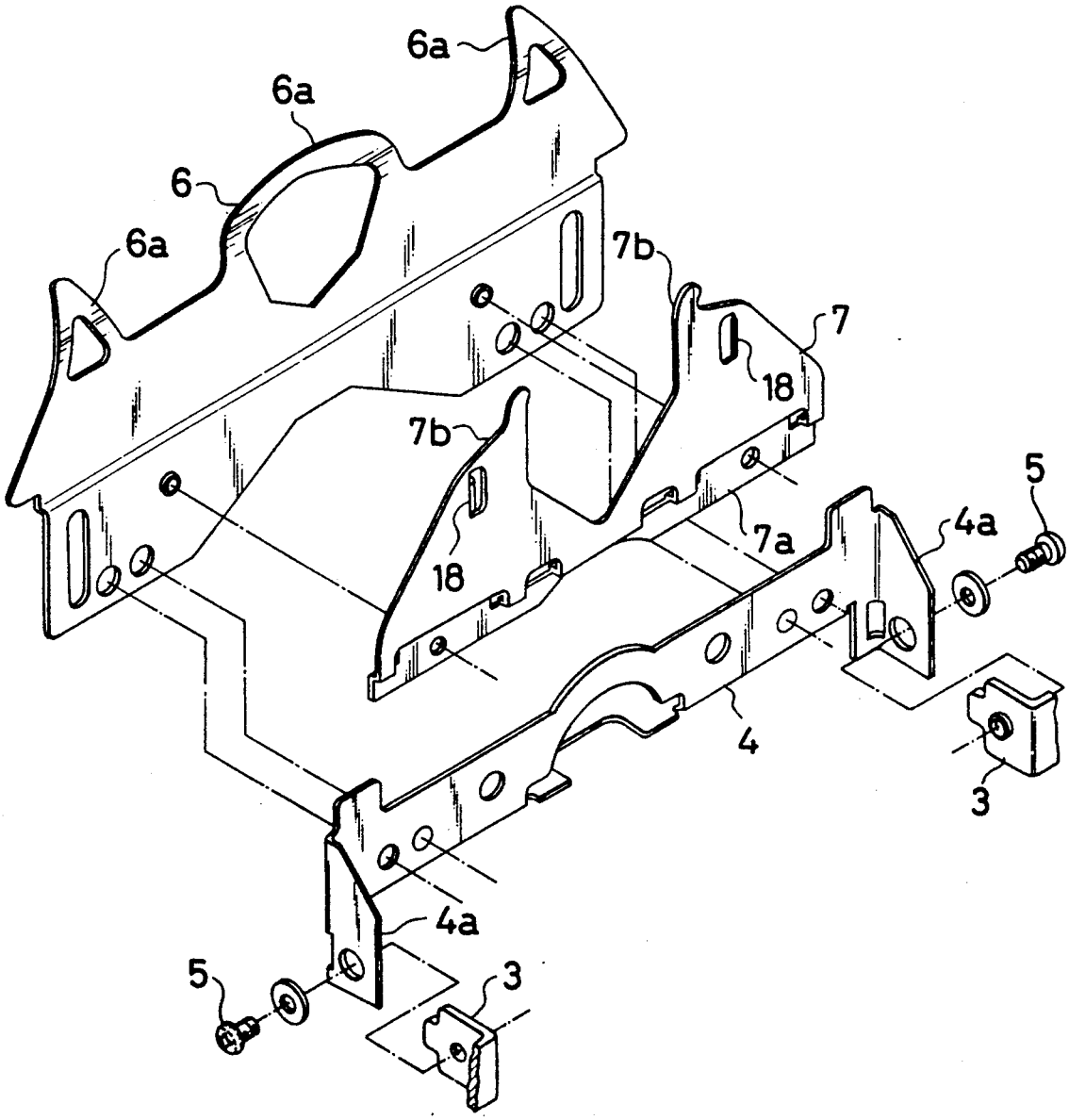
FIG. 1 is an exploded perspective view showing the assembled status of a guide support member, a paper guide member and an ink ribbon guide member of a typewriter embodying the invention.
Figure 2:
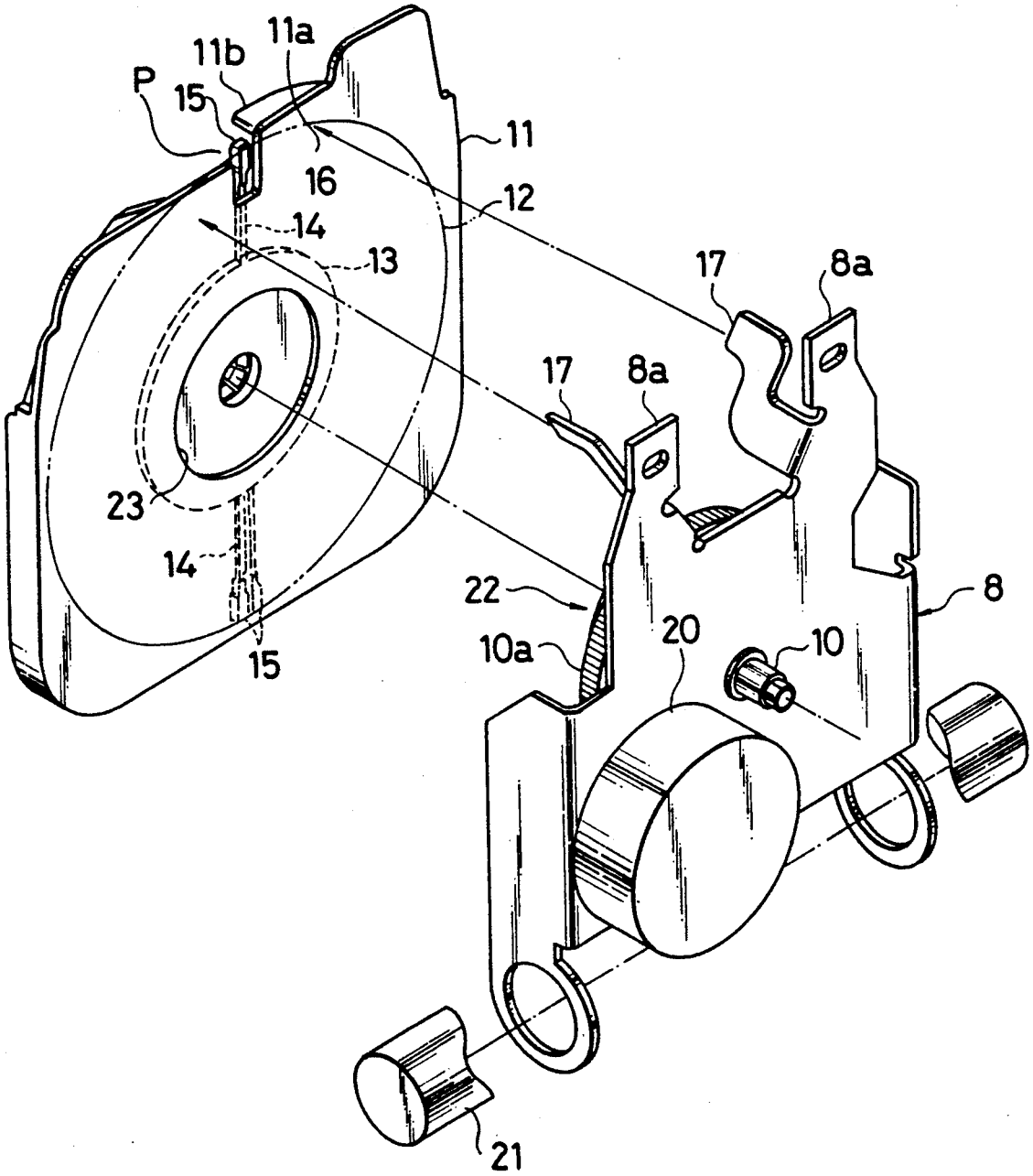
FIG. 2 is an exploded perspective view showing a holder and a type-wheel cassette of the typewriter.
Figure 3:
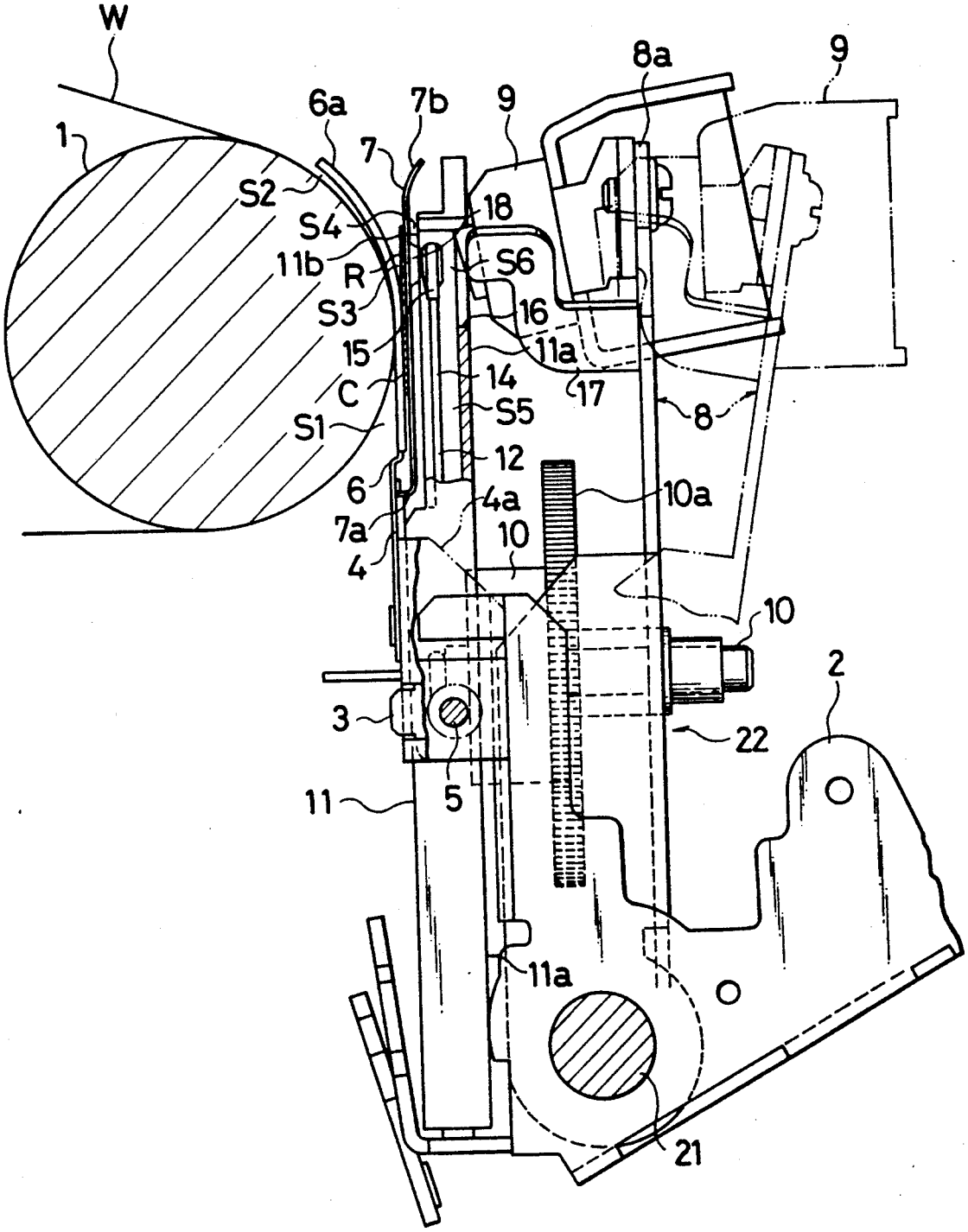
FIG. 3 is a fragmentary side view, partly broken apart, showing the typewriter.

Referring to FIGS. 1 to 3, a carriage 2 movable along a printing line in the longitudinal direction of a platen 1 constitutes support frame means. The carriage 2 has a pair of mounting pieces 3 projecting from its opposite sides toward the platen 1. A guide support member 4 has its opposite end mounting portions 4*a* mounted between and on the mounting pieces 3 by screws 5 for rotational adjustment. A paper guide member 6 formed of a stainless steel plate or like elastic plate is secured by a set screw for positional adjustment to the guide support member 4. As shown in FIG. 3, a paper insertion space S1 is formed between the paper guide member 6 and platen 1. The paper guide member 6 has guide pieces 6*a* projecting from its top and curved to, extend along the platen 1. The guide pieces 6*a* are lightly urged against the outer periphery of the platen 1. When inserting paper sheet W, they can be elastically deformed away from the platen 1 to permit passage of the paper sheet W through the paper insertion space S1. At this time, a paper passage space S2 is formed.

On one side of the paper guide member 6, more specifically on the side thereof opposite the platen 1 as shown in FIG. 1, an ink ribbon guide member 7 consisting of a stainless steel plate or like spring member has its lower bent portion 7*a* secured to the paper guide member 6. The ink ribbon guide member 7 has a pair of, i.e., left and right, integral guide pieces 7*b* upwardly projecting from the lower bent portion 7*a*. A running space S3 for printing ink ribbon R and correction ink ribbon C, as shown in FIG. 3, is formed between the guide pieces 7*b* and paper guide member 6.

In the carriage 2, a holder 8 has its opposite side lower end portions slidably supported on a guide shaft 21 parallel to the printing line such that it is rockable between a type-wheel cassette holding position as shown by solid line in FIG. 3 and a type-wheel cassette detachment position as shown by phantom line. It is pivotally urged by a spring toward the type-wheel cassette detachment position by a spring (not shown), and it can be locked at the two positions by well-known locking means (not shown). Thus, at its type-wheel cassette holding position shown by solid line in FIG. 3, the holder 8 assumes a predetermined position relative to the carriage 2. As shown in FIG. 3, a printing hammer 9 is mounted on a pair, i.e., left and right, mounting pieces 8*a* provided on the top of the holder 8. In a central portion of the holder 8, a type selection shaft 10 extends of the type selection mechanism 22. Further, a type selection motor 20 of the type selection mechanism 22 for rotating the type wheel 12 is provided on the side of the holder 8 opposite the platen 1, with its gear (not shown) provided on its shaft being in mesh with a large gear wheel 10*a* provided on the type selection shaft 10 for torque transmission.

The carriage 2, which is slidably mounted on the guide shaft 21, is movable by other guide means (not shown) while holding its position as shown in FIG. 3.

The guide support member 4, paper support member 6 and ink ribbon guide member 7 are fabricated from steel plate by pressing. The holder 8 is similarly fabricated by pressing with a steel plate having a large thickness. A type-wheel cassette 11 is detachably mounted in the holder 8. The housing of the cassette 11 accommodates a rotatable type-wheel 12 of the daisy wheel type. The type-wheel 12 has a central boss portion 13 capable of being coupled to the type selection shaft 10. A plurality of spokes 14 radially projects from the boss section 13. Each spoke 14 has an integral type 15 provided at its free end.

When the type-wheel cassette 11 is inserted between the holder 8 and paper guide member 6, and the holder 8 is set in the cassette holding position with a lower portion of the type-wheel cassette 11 supported by the carriage 2 as shown in FIG. 3, the type selection shaft 10 penetrates a central opening 23 formed in the housing of the type-wheel cassette 11 and is engaged with the boss portion 13 thereof. At this time, a type 15 is located at a printing position P facing the printing hammer 9 and platen 1 via a notch 16 of the type-wheel cassette 11, whereby a positional relationship is established among the type wheel 12, printing hammer 9 and platen 1.

The holder 8 has a pair of positioning pieces 17 serving as first positioning means projecting from its upper portion toward the platen 1 on the opposite sides of the printing hammer 9. The ink ribbon guide 7 has a pair of integral urging pieces 18 as second positioning means projecting such as to face the respective positioning pieces 17 on the opposite side of the type-wheel cassette 11. On the basis of the elasticity of the ink ribbon guide member, the type-wheel cassette 11 is urged against the positioning pieces 17 on the second side wall 11*a* of the housing of the type-wheel 12 more remote from the platen 1 than the first side wall 11*b* with the engagement between the urging pieces 18 and corresponding side wall 11*b* of the housing of the type-wheel cassette 11, whereby a fixed gap S4 is defined between the guide pieces 7*b* of the ink ribbon guide member 7 and type-wheel cassette 11.

The pair of positioning pieces 17 of the holder 8 are formed integrally of a metal plate pressing such that they extend substantially perpendicular to the surface of the vertical main plate portion of the holder 8. They are symmetrical with respect to the type 15 of the printing position P, and are in contact with the second side wall 11*a* of the type-wheel cassette 11 near the type 15 as shown by the arrows in FIG. 2. The pair of urging pieces 18 facing the positioning pieces 17 are formed when forming the ink ribbon guide member 7 by pressing from a leaf spring material such that they project upright from the surface of the guide member 7. They are adapted to be in contact in a symmetrical state with the side surface 11*b* of the type-wheel cassette 11 opposite the positioning pieces 17 near the printing position P.

For mounting the type-wheel cassette 11 on the carriage 2 in the typewriter having the above construction, the holder 8 is turned in the clockwise direction toward the cassette detachment position as shown by phantom line in FIG. 3, and the type-wheel cassette 11 is inserted between the paper guide member 6 and holder 8. Then, the holder 8 is turned against a spring (not shown) beyond the cassette holding position as shown by solid line in FIG. 3 toward the platen and is then returned to the cassette holding position, whereby it is locked to the carriage 2 by locking means (not shown). During this time, an upper portion of the type cassette 11 is moved toward the urging pieces 18. At the same time, the type-wheel cassette 11 is turned upright, and the ink ribbon guide member 7 is biased toward the platen against its elasticity by the engagement between the upper portion of the first side wall 11*b* of the type-wheel cassette 11 and urging pieces 18. When the holder 8 is returned to the cassette holding position as shown by solid line in FIG. 2, the ink ribbon guide member 7 is returned to the hammer side by its elasticity, and the type-wheel cassette 11 is urged against the positioning pieces 17 by the urging pieces 18. In this state, the type-wheel cassette 11 is held in position.

Thus, a constant gap S4 is defined between the guide pieces 7*b* of the ink ribbon guide member 7 and first side wall 11*b* of the type-wheel cassette 11.

With the switching of the position of the holder 8 to the cassette holding position, the end of the character selection shaft 10 on the holder 8 penetrates the opening 23 of the type-wheel cassette 11 and is fitted in the boss section 13 of the type-wheel 12. When the holder 8 is held in the cassette holding position, a gap S6 between the printing hammer 9 and corresponding surface of the type 15 and a gap S4 between the type-wheel 12 and type-wheel cassette 11 are defined via the holder 8 and type selection shaft 10.

In this state, the type-wheel 12 is rotated by the character selection motor 20 via a gear (not shown) coupled thereto, a large gear 10*a* and character selection shaft 10 to select a given type 15. The selected type 15 is located at the printing position P to face the printing hammer 9. Then, the printing hammer 9 is operated to hammer the selected type 15 against paper sheet W on the platen 1. At this time, the gaps S4 and S5 as noted above are held at present constant values. Thus, a high quality, sharp character print can be obtained.

Further, in this embodiment it is possible to readily adjust the running space S3 for ink ribbons R and C and pressure with which the paper sheet W is urged by the guide pieces 6*a* of the paper guide member 6 by loosening the screws 5, turning the guide support member 4, paper guide member and ink ribbon guide member 7 in unison with one another and adjusting the mounting position and angle of these components, as shown in FIGS. 1 and 3. In this case, the type-wheel cassette 11 is urged against the positioning pieces 17 by the urging pieces 18 to be held at a fixed position with reference to the holder 8. Thus, the gap S4 between the guide pieces 7*b* of the ink ribbon guide member 7 and type-wheel cassette 11 and the gap S5 between the type-wheel cassette 11 and type-wheel 12 are not varied, and the gap between the printing ribbon R and type 15 and the gap between the type 15 and printing hammer 9 are held at fixed values. It is thus possible to simplify the adjusting operation and alleviate the operator's burden.

The above embodiment is by no means limitative. For example, it is possible to form the paper guide member 6 by bending a rigid steel plate and permit adjustment of the size of the paper passage space S2 through adjustment of the mounting position of the paper guide member 6 via the guide support member 4.

Further, while in the above embodiment the urging pieces 18 serving as the second positioning means are provided on the ink ribbon guide member 7, it is also possible to provide urging pieces on a member provided separately from the guide member 7 and between the platen 1 and type-wheel cassette 11.

Further, in the above embodiment the pair of positioning pieces 17 and urging pieces 18 are provided symmetrically on the opposite side of the selected type 15 at the printing position P and in a spaced-apart relation to one another along the printing line. This arrangement permits balanced, uniform and accurate positioning of components in the neighborhood of the printing position. However, the number of positioning pieces 17 and urging pieces 18 in the above embodiment are by no means limitative.

Still further, while the above embodiment is concerned with a typewriter having the carriage 2 movable along the printing line, the invention is also applicable to a printer with a stationary carriage and a movable platen.

What is claimed is:

1. In a printer comprising:

a platen;

a type-wheel cassette rotatably accommodating a type-wheel with a plurality of types, said type-wheel cassette having a first side surface close to said platen and a second side surface more apart from said platen than said first side surface;

type selection means for rotatably driving said type-wheel to selectively position a type on said type-wheel at a printing position facing, on a printed line said platen in engagement with said type-wheel;

printing hammer means for effecting a printing operation by hammering said selected type of said type-wheel at said printing position against said platen; and support frame means having a mounting position in which said type-wheel cassette is removably mounted, said support frame means being movable along said platen, a type-wheel cassette positioner comprising:

a holder supported by said support frame means so as to be moved relatively to the support frame means between a type-wheel cassette holding position at which said type-wheel cassette is held in said mounting position, at which said type-wheel cassette is allowed to be removed from said mounting position;

first positioning means formed integrally with said holder, extending toward said type-wheel cassette mounted in said mounting position on said support frame means, said first positioning means being able to engage said second side surface adjacent to the selected type disposed at said printing position;

an intervening member secured to said support frame means and located between said type-wheel cassette mounted in said mounting position and said platen; and second positioning means formed integrally with said intervening member, extending toward said type-wheel cassette mounted in said mounted position on said support frame means, said second positioning means being able to engage said first side surface adjacent to the selected type disposed at said printing position so that said first and second positioning means face each other on the opposite sides of the type-wheel cassette, whereby positioning of the type-wheel cassette to said mounting position is ensured by co-operation of said first and second positioning means, wherein:

said first positioning means includes a pair of urging pieces spaced apart on the opposite sides of said printing position along said printing line; and said second positioning means includes a pair of second urging pieces spaced apart on the opposite sides of said printing position along said printing line, said first and second urging pieces facing one another on the opposite sides of said type-wheel cassette.

2. The type-wheel cassette positioner according to claim 1, wherein said intervening member is composed of a leaf spring member having a spring action for urging said type-wheel cassette against said first positioning means by the engagement with said first side surface of said type-wheel cassette and said second positioning means.

3. The type-wheel cassette positioner according to claim 2, wherein said intervening member is a ribbon guide member for guiding a printing ink ribbon disposed between said platen and type-wheel cassette.

4. The type-wheel cassette positioner according to claim 1, wherein said holder is rockable between said type-wheel cassette holding position and said detachment position.

5. The type-wheel cassette positioner according to claim 4, wherein said support frame means includes a carriage slidably supported on a shaft substantially parallel to said platen, and said holder is pivotally mounted for rocking about said shaft.

* * * * *